US007624881B2

(12) United States Patent
Wilfong, Jr.

(10) Patent No.: US 7,624,881 B2
(45) Date of Patent: Dec. 1, 2009

(54) DISPENSING APPARATUS FOR PLASTIC BAGS

(75) Inventor: Harry B. Wilfong, Jr., Hartsville, SC (US)

(73) Assignee: Hilex Poly Co., LLC, Hartsville, SC (US)

( * ) Notice: Subject to any disclaimer, the term of this patent is extended or adjusted under 35 U.S.C. 154(b) by 574 days.

(21) Appl. No.: 10/760,925

(22) Filed: Jan. 20, 2004

(65) Prior Publication Data

US 2005/0178736 A1 Aug. 18, 2005

(51) Int. Cl.
*G07F 11/04* (2006.01)

(52) U.S. Cl. ..... 211/59.2; 211/59.1; 221/26

(58) Field of Classification Search ..... 211/59.1, 211/12, 85.15, 54.1, 57.1, 59.2; 221/26, 221/43, 44, 46, 63; 206/470, 554; 248/95, 248/100

See application file for complete search history.

(56) References Cited

U.S. PATENT DOCUMENTS

| | | | | | |
|---|---|---|---|---|---|
| 271,177 | A | | 1/1883 | White | |
| 328,888 | A | | 10/1885 | Hunt | |
| 374,399 | A | * | 12/1887 | Donovan | 221/26 |
| 559,469 | A | * | 5/1896 | Thorn et al. | 221/26 |
| 604,113 | A | * | 5/1898 | Fisher | 221/43 |
| 1,481,063 | A | * | 1/1924 | O'Brien | 211/57.1 |
| 1,953,887 | A | * | 4/1934 | Medoff | 206/37 |
| 2,831,601 | A | | 4/1958 | Treiss | |
| 3,033,362 | A | | 5/1962 | Marcalus | |
| 3,044,233 | A | * | 7/1962 | Altman, Jr. | 53/385.1 |
| 3,144,961 | A | | 8/1964 | Phenner | |
| 3,145,839 | A | * | 8/1964 | Lowry | 206/493 |
| 3,231,164 | A | | 1/1966 | Seidler | |
| 3,285,407 | A | | 11/1966 | Abramson | |
| 3,473,756 | A | | 10/1969 | Jones | |
| 3,589,555 | A | | 6/1971 | Burkhalter, Jr. | |
| 3,606,080 | A | * | 9/1971 | Lynch | 221/63 |
| 3,738,482 | A | * | 6/1973 | Cwikla | 206/229 |
| 3,747,298 | A | * | 7/1973 | Lieberman | 53/390 |
| 3,763,627 | A | | 10/1973 | Kupcikevicius et al. | |

(Continued)

FOREIGN PATENT DOCUMENTS

FR 2 592 367 A1 3/1987

(Continued)

*Primary Examiner*—Katherine W Mitchell
*Assistant Examiner*—Colleen M Quinn
(74) *Attorney, Agent, or Firm*—Alston & Bird LLP

(57) ABSTRACT

A dispensing apparatus for header-style bags having a housing comprising a rear portion and a front cover connected to the rear portion, and a bag mount attached to the rear portion proximate the top edge thereof, the bag mount structured and arranged to engage the aperture in the packet of bags so as to hang the packet from the bag mount. The front cover is pivotally attached to the rear portion so as to be movable between a lowered, open position providing access to an interior of the housing so that a lower portion of a packet of bags hanging from the bag mount can be received in the interior of the housing, and a raised, closed position in which the housing substantially encloses the lower portion of the packet of bags while the mouth portion of the packet of bags projects above the housing to allow a bag to be grasped at an upper end thereof and removed from the packet.

30 Claims, 10 Drawing Sheets

U.S. PATENT DOCUMENTS

| | | | | | |
|---|---|---|---|---|---|
| 4,155,458 | A | | 5/1979 | Moline | |
| 4,305,503 | A | * | 12/1981 | Membrino | 206/554 |
| 4,417,669 | A | * | 11/1983 | Knowles et al. | 221/26 |
| 4,453,649 | A | * | 6/1984 | Origuchi | 221/26 |
| 4,506,801 | A | * | 3/1985 | Origuchi | 221/26 |
| 4,519,504 | A | | 5/1985 | Nausedas | |
| 4,527,693 | A | | 7/1985 | Membrino | |
| 4,537,330 | A | | 8/1985 | Gelbard | |
| 4,630,332 | A | | 12/1986 | Bisbing | |
| D287,572 | S | | 1/1987 | Dancy | |
| D288,779 | S | | 3/1987 | Pilon | |
| 4,678,099 | A | | 7/1987 | Matsui | |
| 4,805,969 | A | * | 2/1989 | Heacock | 312/50 |
| 4,830,317 | A | | 5/1989 | Kober et al. | |
| 4,936,466 | A | | 6/1990 | Nava | |
| D312,178 | S | | 11/1990 | Fautley | |
| 4,993,589 | A | | 2/1991 | McLaughlin | |
| 5,042,687 | A | * | 8/1991 | McKinley | 221/311 |
| 5,060,809 | A | | 10/1991 | Bayes et al. | |
| 5,096,089 | A | | 3/1992 | McLaughlin | |
| D329,344 | S | | 9/1992 | Carillo | |
| 5,184,728 | A | | 2/1993 | Wile | |
| 5,205,435 | A | | 4/1993 | Daniels | |
| 5,269,416 | A | * | 12/1993 | DeMatteis | 211/50 |
| 5,269,423 | A | | 12/1993 | Nguyen | |
| 5,332,097 | A | | 7/1994 | Wile | |
| 5,368,165 | A | * | 11/1994 | Ngyuen | 206/554 |
| 5,386,910 | A | | 2/1995 | Liss | |
| 5,405,021 | A | * | 4/1995 | Smithson | 211/50 |
| D358,325 | S | | 5/1995 | McNaughton | |
| 5,497,884 | A | * | 3/1996 | DeMatteis et al. | 206/554 |
| RE35,207 | E | | 4/1996 | Daniels | |
| 5,509,570 | A | * | 4/1996 | DeMatteis | 221/33 |
| 5,562,580 | A | * | 10/1996 | Beasley et al. | 493/194 |
| 5,577,615 | A | * | 11/1996 | Wile et al. | 206/554 |
| 5,695,065 | A | | 12/1997 | Kennedy et al. | |
| 5,732,833 | A | | 3/1998 | Alvarado et al. | |
| 5,941,393 | A | | 8/1999 | Wilfong, Jr. | |
| 6,021,784 | A | | 2/2000 | Yuhara | |
| 6,021,919 | A | | 2/2000 | Kelly | |
| 6,098,806 | A | * | 8/2000 | Mills | 206/554 |
| 6,142,302 | A | | 11/2000 | Requena | |
| 6,230,929 | B1 | * | 5/2001 | Phelps et al. | 221/46 |
| 6,230,953 | B1 | * | 5/2001 | Simhaee | 225/46 |
| 6,264,059 | B1 | | 7/2001 | Requena | |
| 6,401,971 | B1 | * | 6/2002 | Edwards et al. | 221/26 |
| 6,446,811 | B1 | | 9/2002 | Wilfong, Jr. | |
| 6,505,750 | B1 | | 1/2003 | Nguyen | |
| 6,557,723 | B2 | * | 5/2003 | Chen | 221/45 |
| 6,571,984 | B1 | | 6/2003 | Winesett | |
| 6,585,197 | B1 | | 7/2003 | Daniels | |
| 6,651,832 | B1 | | 11/2003 | Nguyen | |
| D482,915 | S | | 12/2003 | Yang et al. | |
| 6,655,546 | B1 | | 12/2003 | Bolton et al. | |
| 6,708,841 | B2 | * | 3/2004 | Baughman | 221/46 |
| 6,729,483 | B1 | | 5/2004 | Nguyen et al. | |
| 6,779,683 | B2 | | 8/2004 | Taylor et al. | |
| D505,036 | S | | 5/2005 | Wilfong, Jr. | |
| 6,988,635 | B2 | | 1/2006 | Hochtritt et al. | |
| 7,047,599 | B2 | | 5/2006 | Oshima et al. | |
| 7,134,571 | B2 | | 11/2006 | Hochtritt et al. | |
| 7,172,092 | B2 | | 2/2007 | Yang et al. | |
| D547,580 | S | | 7/2007 | Wilfong, Jr. | |
| 7,353,569 | B2 | | 4/2008 | Chen et al. | |
| D576,824 | S | | 9/2008 | Eksrom | |
| 7,426,406 | B2 | | 9/2008 | Maatta et al. | |
| 2003/0010788 | A1 | | 1/2003 | Chen | |
| 2003/0136793 | A1 | | 7/2003 | Chen | |
| 2004/0026439 | A1 | * | 2/2004 | Bolton | 221/26 |
| 2004/0040974 | A1 | | 3/2004 | Chen | |
| 2005/0056656 | A1 | | 3/2005 | Hochtritt et al. | |
| 2005/0178736 | A1 | | 8/2005 | Wilfong, Jr. | |
| 2005/0218093 | A1 | | 10/2005 | Alvarado | |
| 2006/0021956 | A1 | | 2/2006 | Wilfong, Jr. | |
| 2006/0196524 | A1 | | 9/2006 | Yuhara | |
| 2007/0186515 | A1 | | 8/2007 | Ruetten et al. | |
| 2007/0215494 | A1 | | 9/2007 | Yuhara | |

FOREIGN PATENT DOCUMENTS

| | | | | |
|---|---|---|---|---|
| GB | 2035264 | A | * | 6/1980 |
| GB | 2 234 738 | A | | 2/1991 |
| GB | 2 274 098 | A | | 7/1994 |
| GB | 2 329 171 | A | | 3/1999 |
| GB | 2 329 629 | A | | 3/1999 |
| GB | 2332422 | | * | 6/1999 |
| GB | 2 385 314 | A | | 8/2003 |
| JP | 8-210015 | A | | 8/1996 |
| MX | PA05000860 | A | | 8/2005 |
| WO | WO 2005/037015 | A1 | | 4/2005 |

* cited by examiner

DISPENSING APPARATUS FOR PLASTIC BAGS

BACKGROUND OF THE INVENTION

The invention relates to a dispensing apparatus for dispensing plastic bags, such as the type commonly provided in the produce section of a grocery store for customers' use, from a stack of serially arranged bags that are flattened and folded and stacked together.

Plastic bags have been replacing paper bags in the United States since the 1970s (and elsewhere more recently) in the grocery and retail products industries as a result of the superior and inherent moisture-resistant properties and strength of plastic. In these industries, these plastic bags have usually included integrally connected front and rear wall portions and, sometimes, gusseted side wall portions, all secured together at the bottoms thereof by a seal to define a closed bottom on the bag. The bag walls are open at the top to define a mouth portion on the bag. Some of these bags are of the "T-shirt" type which provides spaced integral handles laterally extending upwardly from opposed sides of the open mouth of the bag at the top to provide ease in carrying of the bag by the consumer. However, these plastic bags have also included handleless, generally flat-top rectangular-shaped bags, similar to the prior paper bags, without upwardly extending handles. These plastic bags have been provided to and used by the grocery and retail product industries in the form of packs of a plurality of superimposed bags connected together and adapted to be serially opened and removed from the rack, or in the form of a roll of plastic bags connected end-to-end and mounted on a rack to be serially removed and opened up, for packaging of the grocery or retail products. The produce bag market in the United States grocery industry has been dominated over the years by plastic bags on a roll. These bags are typically manufactured of LDPE or HMW-HDPE in gauges from 0.50 to 0.35 mil. The biggest complaint with this style bag by shoppers is the difficulty in getting the bag opened.

More recently, grocery produce bags of the "star seal" configuration have been introduced. The star seal design, which is well known in the industry as a bag having multiple layers and longitudinally folded over on itself and sealed at the bottom so that when it is opened up, the bottom of the bag viewed from the inside resembles a star, got its start in the HMW-HDPE can liner market because of the excellent bottom seal strength it offers with thin-gauge films.

Star seal bags have been provided both in roll form as described for instance in U.S. Pat. No. 6,230,953, and in pack form as described in U.S. Pat. No. 5,941,393 and U.S. Pat. No. 6,446,811, the disclosures of which are incorporated herein by reference.

Grocery produce bags of this star seal type have been accepted in part because of their strength, but also because they are somewhat easier to open than the traditional roll produce bags. Openability of this star seal type bag is improved as a result of the increased number of layers of film at the bag mouth. However, particularly with respect to the roll form star seal bags, shoppers still often mistake the bottom of the bag for the top of the bag, leading to frustration in opening of the bag.

Additionally, star seal bags and other configurations of bags provided in packets, which can include bags generally referred to as header-style bags as well as T-shirt type bags, up to now have been dispensed from a rack having one or more hooks from which one or more stacks of bags hang down, as depicted in the above-referenced patents. The amount of vertical space occupied by the hanging bags thus is at least as great as the length of the bags, which typically is about 20 inches. It would be desirable to provide a dispensing apparatus that takes up less space and has better aesthetics than such prior dispensing racks.

BRIEF SUMMARY OF THE INVENTION

The invention addresses the above needs and achieves other advantages by providing a dispensing apparatus for a packet of bags having a housing configured to house the lower part of a bag packet (i.e., the part distal from the mouth portion of the bags) to substantially prevent access to the lower ends of the bags while allowing a mouth portion of the packet to be accessed through an opening in the housing. A bag mount of the apparatus engages the packet near the mouth portion to secure the packet. Consumers thus can access the upper ends of the bags for removing bags one at a time. The housing in preferred embodiments accommodates bag packets substantially longer than the housing; the lower part of the packet is folded into the housing so that the dispenser is relatively compact in size.

In one embodiment of the invention, the housing comprises a rear portion and a front cover connected to the rear portion. The bag mount is attached to the rear portion proximate the opening in the housing. The front cover is pivotally attached to the rear portion so as to be movable between an open position providing access to an interior of the housing so that a lower portion of a packet of bags attached to the bag mount can be received in the interior of the housing, and a closed position in which the housing substantially encloses said lower portion of the packet of bags while the mouth portion of the packet of bags projects out from the housing to allow a bag to be grasped at an upper end thereof and removed from the packet.

The pivot axis for the front cover is preferably spaced from the bag mount by a distance that is substantially less than the length of the packet of bags. Accordingly, when the front cover is moved to its closed position, the lower portion of the packet of bags is folded into the interior of the housing. Thus, the dispensing apparatus occupies substantially less space than a conventional dispensing rack wherein the packet simply hangs from a hook.

A further advantage of the dispensing apparatus is that the lower ends of the bags are contained in the housing and thus are not readily accessible to shoppers. The upper ends of the bags at the mouth portion of the packet, on the other hand, are presented for ready grasping. The dispensing apparatus thereby encourages proper bag removal (i.e., grasping and pulling the open upper end of a bag to detach it from the packet) and discourages improper bag removal (i.e., grasping and pulling the closed lower end of a bag to detach it from the packet). As a further consequence, shoppers are less likely to attempt to open the lower end of the bag.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
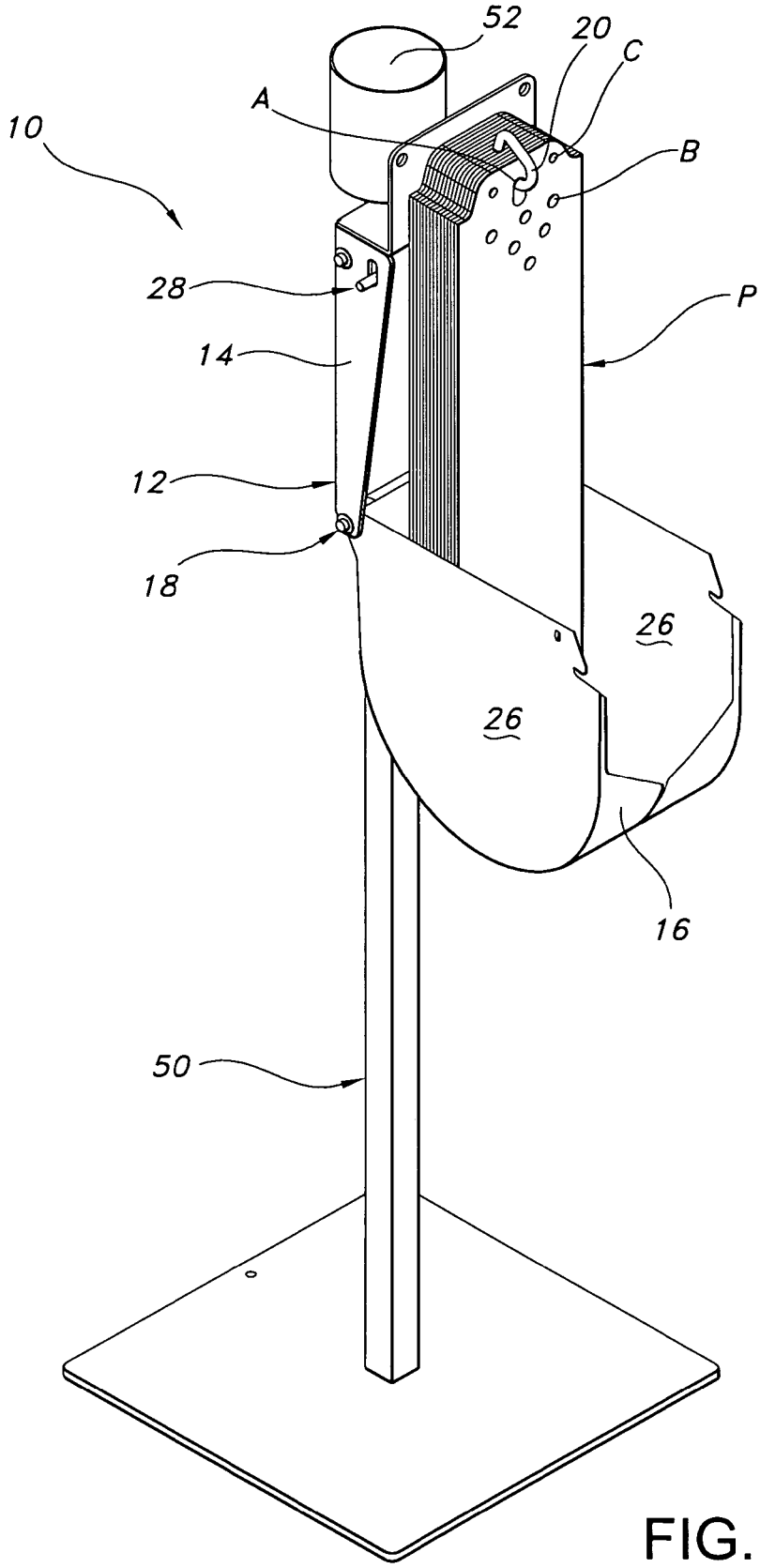
FIG. 1 is a perspective view of a dispenser in accordance with one embodiment of the invention, shown in an open condition with a packet of bags loaded in the dispenser.
Figure 2:
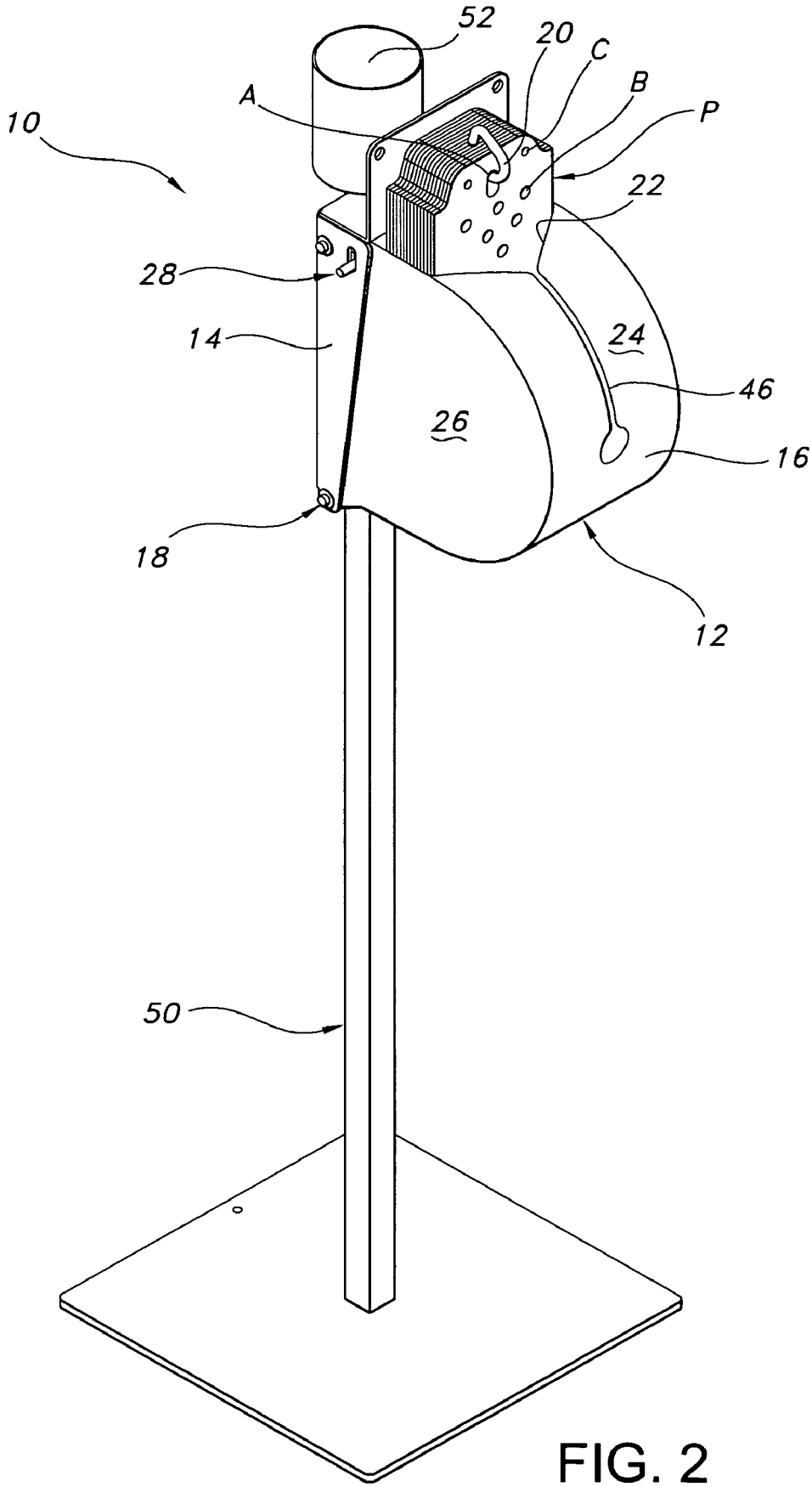
FIG. 2 is a view similar to FIG. 1, showing the loaded dispenser in a closed condition.
Figure 3:
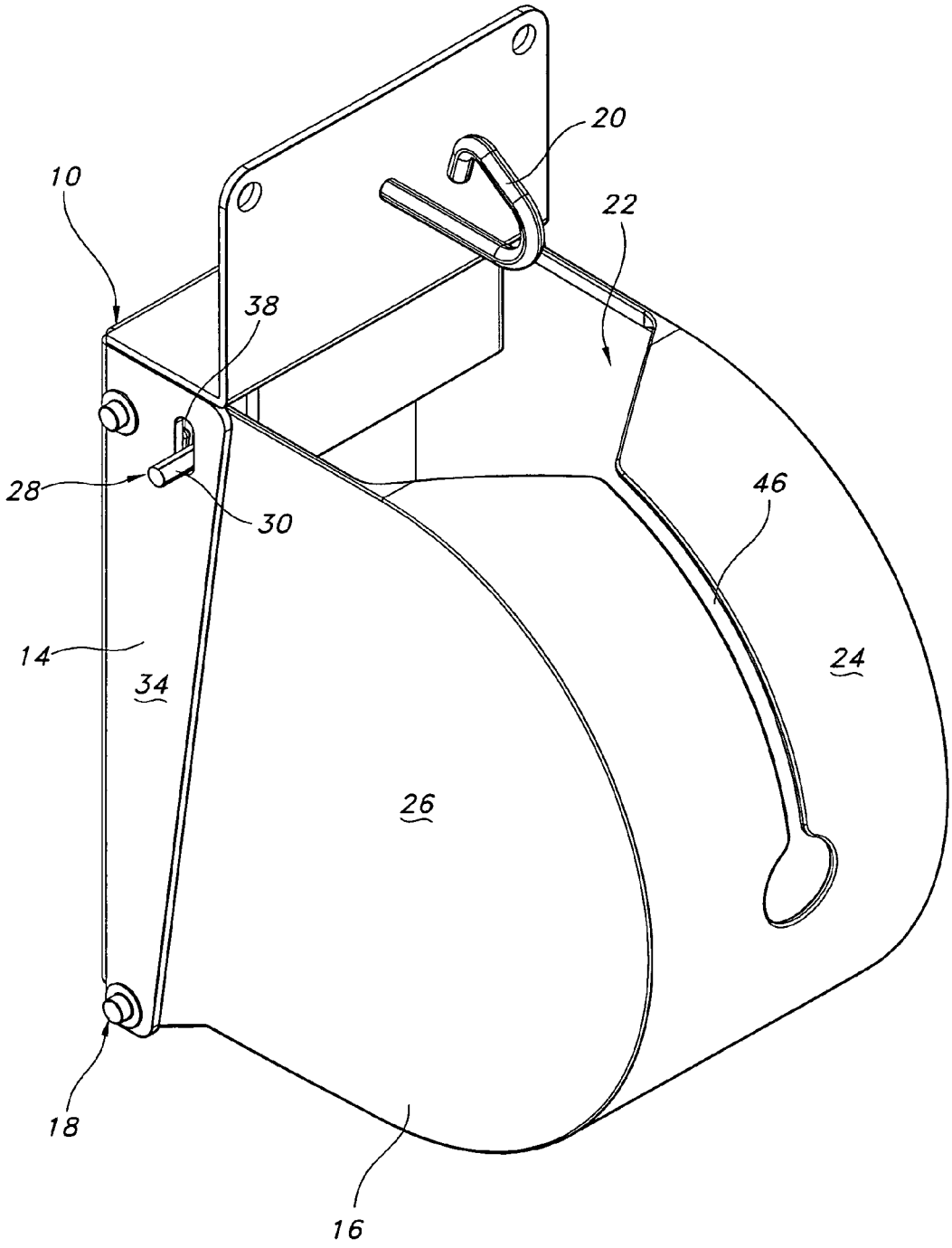
FIG. 3 is a perspective view of a dispenser in accordance with a second embodiment of the invention, shown closed and empty.
Figure 4:
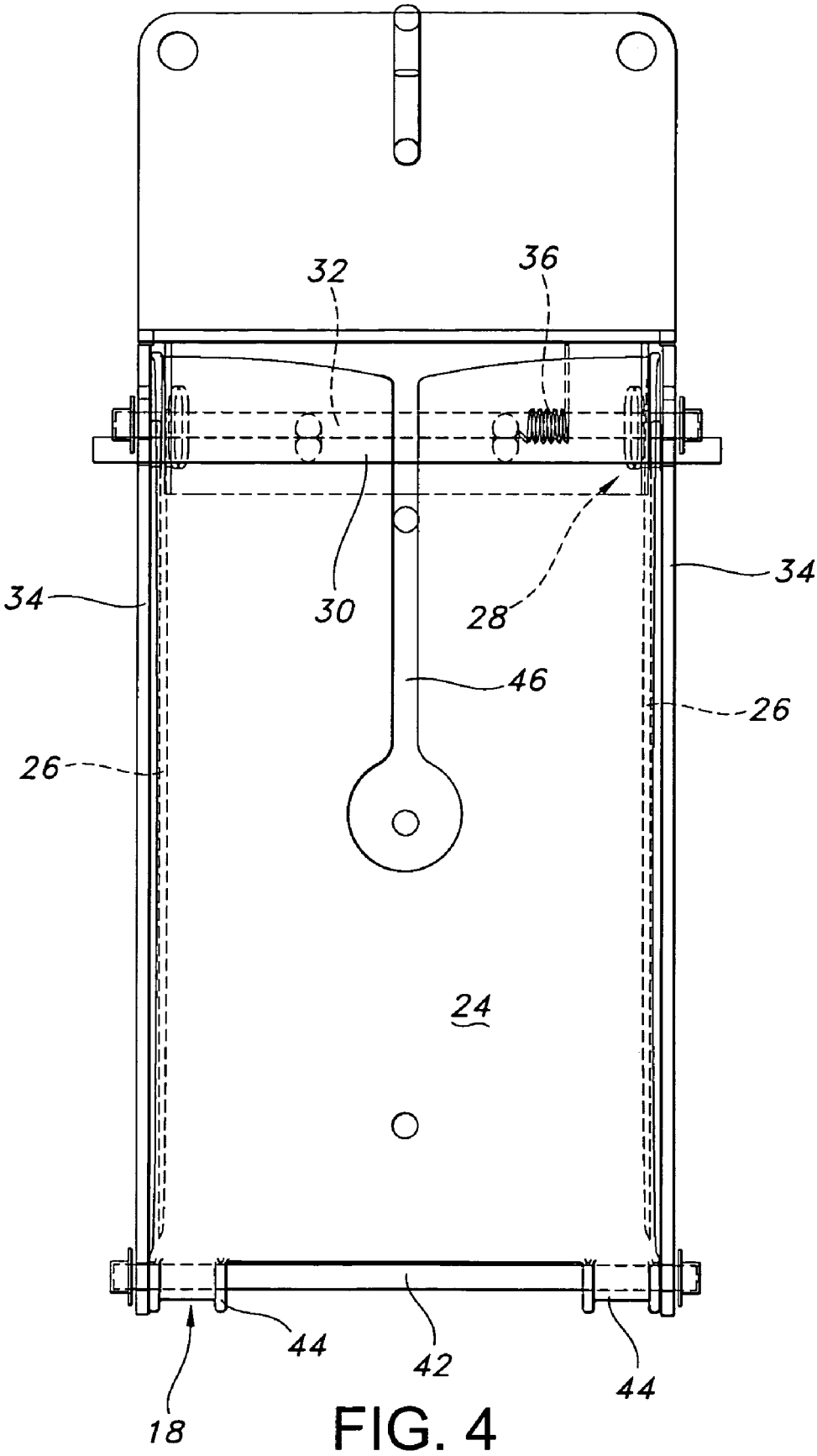
FIG. 4 is a front elevation of the dispenser of FIG. 3.
Figure 5:
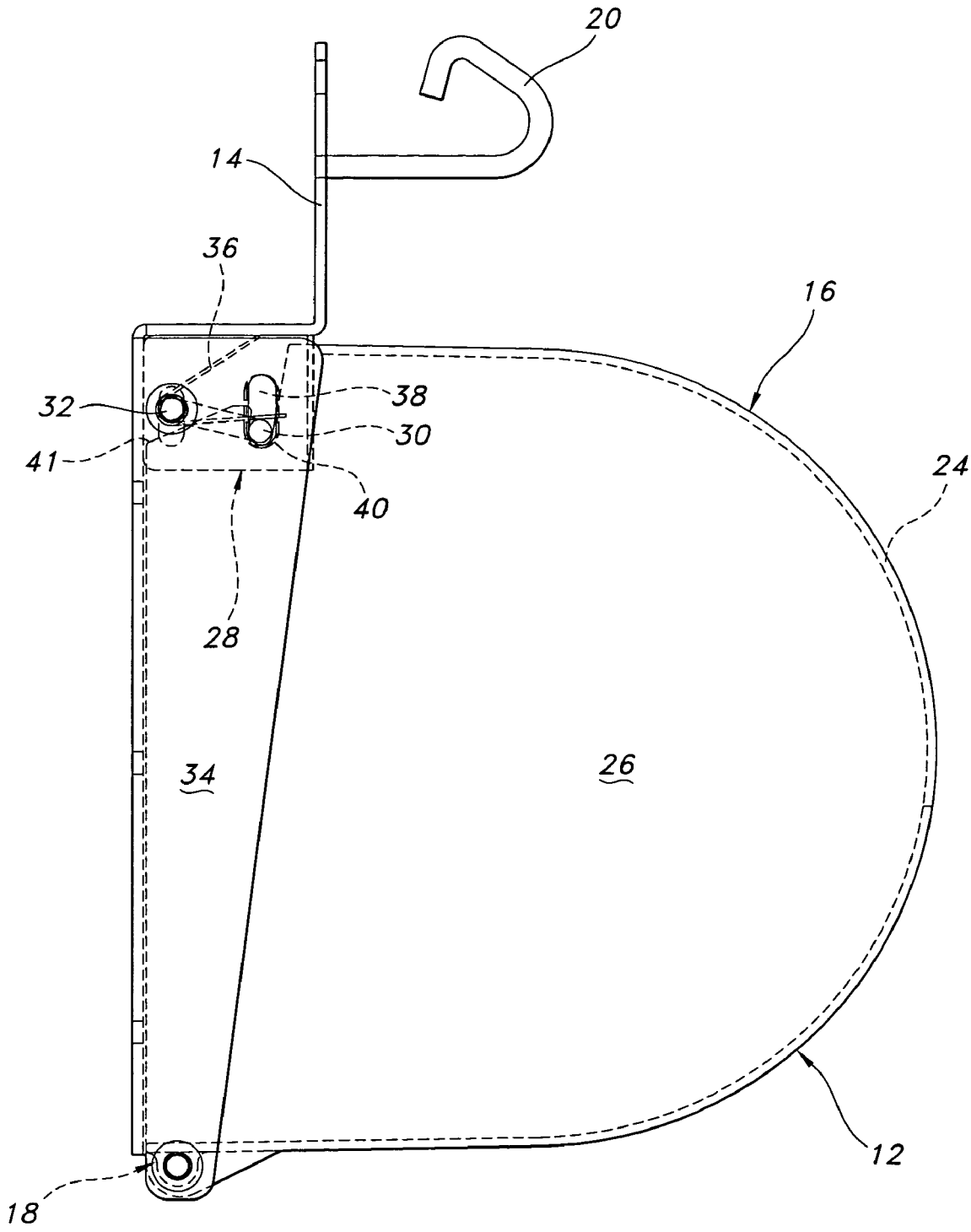
FIG. 5 is a side elevation of the dispenser of FIG. 3.
Figure 6:
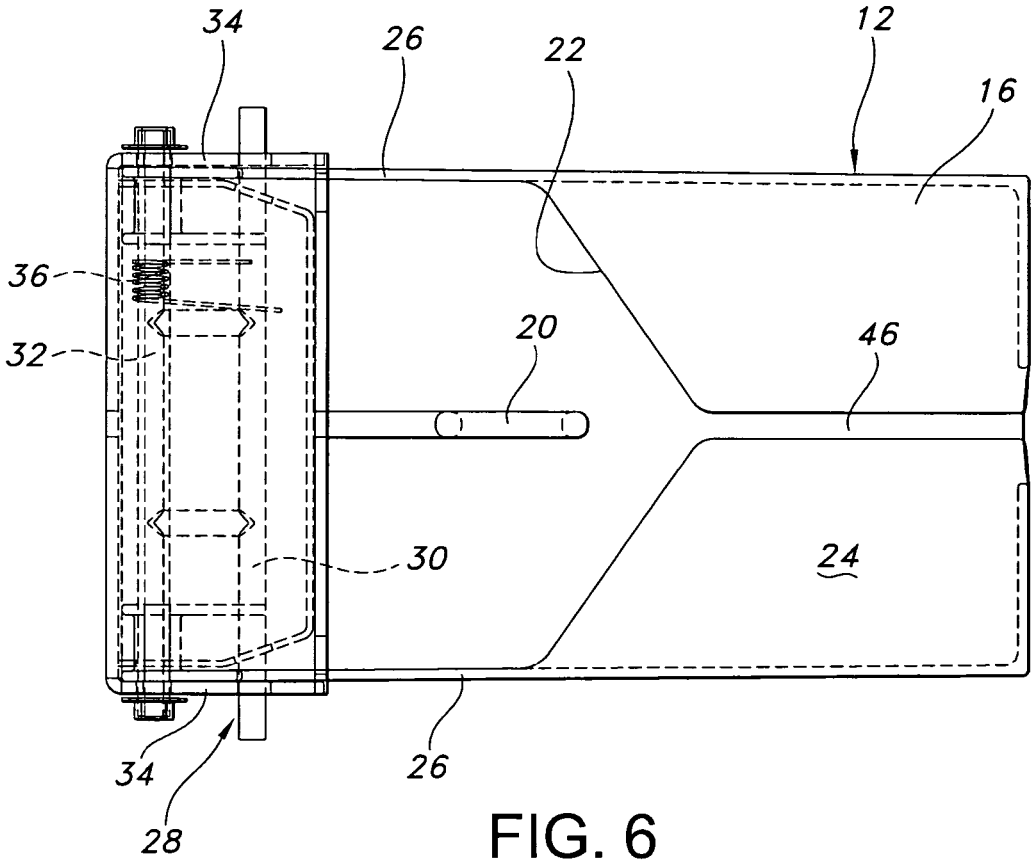
FIG. 6 is a top elevation of the dispenser of FIG. 3.

A dispensing apparatus 10 in accordance with a first embodiment of the invention is depicted in FIGS. 1 and 2, and a dispensing apparatus in accordance with a second embodiment is shown in FIGS. 3-6. The two embodiments differ in only minor respects, as noted below. The dispensing apparatus includes a housing 12 formed by a rear portion 14 and a front cover 16. The rear portion and front cover are pivotally connected to each other by a hinge arrangement 18 located proximate a bottom edge of the rear portion. The hinge arrangement is attached to the front cover 16 at a location proximate a lower end (when the front cover is closed as shown in FIG. 2) of the front cover. By virtue of the hinge arrangement, the front cover can be pivoted between a closed position (FIG. 2) and an open position (FIG. 1).

The front cover and rear portion are suitably shaped so that the housing 12 defines an interior space for accommodating a lower portion of a packet P of bags. The packet P can be any type of bags, including but not limited to header style bags such as described in U.S. Pat. No. 5,941,393 and U.S. Pat. No. 6,446,811, the disclosures of which are incorporated herein by reference, or T-shirt style bags. The packet P has an aperture A extending through the packet proximate a mouth portion of the packet. The mouth portion is the portion of the packet at which the open ends or mouth ends of the bags are located. The dispensing apparatus includes a bag mount or hook 20 for engaging the aperture in the bag packet so that the packet can hang from the hook with the lower portion of the packet contained in the interior space of the housing 12. The illustrated packet P has a protruding mounting "tab" at its mouth portion, through which the aperture A extends, but alternatively the mouth portion of the packet can have other shapes such as squared off, rounded, etc. A bag packet typically has severable support means at the mouth portion, by which bags can be detached from the packet by severing the severable support means. The severable support means can have various forms. In some cases, an aperture extends through the packet at the mouth portion and a notch, perforation, or the like (e.g., see FIG. 1 of the '811 patent) is provided in each bag near the aperture so that the film material of the bag can readily be torn through by pulling the bag away from a hook or the like engaged in the aperture. In other cases, a detachable tab (not shown) can be provided at the mouth portion of the packet, the tab having an aperture therethrough for engagement by a hook or the like; a perforation, notch, or the like, is provided in a film portion connecting the tab to the rest of the packet, such that the film portion can readily be torn through by pulling the bag away from the hook, thereby detaching a bag from its tab, which remains on the hook (e.g., see FIGS. 9-11 of the '811 patent).

The packet P of bags can be constructed so that the bags are self-opening, i.e., each bag tends to open as the bag is removed from the packet P. For example, successive bags in the packet can be joined together by frangible bonds of predetermined strength that facilitate the opening of the bags during removal from the packet. In particular, the bags can be folded so that each respective bag comprises multiple layers in the packet. Less than all of the layers can be bonded to the successive bag, or the layers closest to the successive bag can be bonded thereto by a bond that is stronger than the bond between the other layers of the respective bag and the successive bag. Thus, as a person pulls each bag from the packet, the bond(s) between the bag and the packet can cause the bag to begin to open. Further, before the bag is removed from the packet, the bag can cause the successive bag in the packet to begin to open. Such self-opening bag packets and the formation of bonds in packets to provide the self-opening feature are further described in U.S. Pat. No. 5,335,788, the disclosure of which is incorporated herein by reference, as well as in U.S. Pat. No. 6,446,811, noted above. Bonds B, which extend between only select layers of each bag, e.g., to connect the outer layers of adjacent bags in the packet, can be formed by corona treatments. For example, adjacent layers of successive bags in the packet can be exposed to a corona treatment and then pressed together to form a corona-induced pressure bond. Pressure bonded areas or cold welds C can be formed to extend through the packet and join the bags, e.g., to maintain the bags in the configuration of the packet during handling and loading onto the apparatus 10. Such bonds are also described in U.S. Pat. Nos. 5,335,788 and 6,446,811. It is appreciated that the bonds B, C can be formed in various configurations and arrangements in the packet.

The mouth portion of the packet of bags is accessible through an opening 22 defined in the housing 12 between a rear upper edge of the front cover 16 and the rear portion 14. The mouth portion of the bag packet, at which the open upper ends of the bags are located, is thus presented for ready access, while the lower ends of the bags are contained within the housing and hence are not readily accessible as long as the front cover is closed as shown in FIG. 2. While the opening 22 in the illustrated embodiment is on an upper side of the housing, alternatively the opening can be on another side of the housing, such as the front side.

The front cover 16 in the illustrated embodiment has a somewhat cylindrical configuration, formed by a front panel 24 of curved, generally U-shaped form, and a pair of spaced, parallel side panels 26 joined to the opposite side edges of the front panel 24. The front cover thus is open on one side that faces the rear portion 14 when the front cover is closed. The rear portion substantially closes the open side of the front cover when the front cover is closed, but the open side is exposed when the front cover is opened, so that the lower portion of a bag packet can be received into the front cover as in FIG. 1.

The dispensing apparatus 10 further comprises a latching arrangement 28 for latching the front cover in the closed position. With particular reference to FIGS. 3-6, the latching arrangement includes a latch member 30 in the form of a wire or rod, connected to a pivot member 32 also in the form of a wire or rod, such that the latch member 30 is substantially parallel to the pivot member 32 and is spaced from the pivot member in a forward direction (i.e., toward the front cover 16). The pivot member 32 is journaled for rotation about its axis in apertures formed through a pair of laterally spaced, parallel walls 34 that are joined to opposite side edges of the rear portion 14, the journaling apertures in the walls 34 being located proximate an upper end of the front cover 16 when the front cover is closed. When the pivot member 32 is rotated one direction or the other through an angle about its axis, the latch member 30 is caused to move up or down along an arc. A torsion spring 36 is affixed to the pivot member 32 and engages the latch member 30 to bias the latch member in a downward direction. The opposite ends of the latch member 30 extend outwardly through vertically elongated apertures 38 in the walls 34, and the torsion spring 36 biases the latch member downwardly against the lower edges of the apertures 38.

In this lowered position of the latch member 30, and when the front cover 16 is closed, the latch member is located in latching slots 40 defined in upper edges of the side panels 26 of the front cover. The engagement of the latch member 30 in the latching slots 40 prevents the front cover from being opened. To open the front cover, the opposite ends of the latch member 30 are pushed upwardly against the force of the torsion spring 36 to disengage the latch member from the latching slots 40, and the front cover is pulled forwardly. When the latch member is released, it returns to its lowered position by action of the torsion spring. The upper edges of the side panels 26 of the front cover can be provided with ramped cam surfaces 41 (FIG. 5) for engaging the latch member and pushing it upwardly as the front cover is moved toward its closed position; once the latch member encounters the latching slots 40 it will snap into the slots by action of the torsion spring. Thus, closing the front cover and latching it closed does not require manipulation of the latch member by hand. Advantageously, however, the front cover cannot be opened unless the latch member is lifted.

The hinge arrangement 18, previously referred to, includes a hinge wire or pin 42 rotatably journaled in apertures formed through the walls 34 at locations proximate the lower edge of the rear portion 14. The pin 42 extends through apertures formed through lugs or bushings 44 affixed to the rear lower end of the front cover 16. If it is desired to prevent the front cover from being able to freely fall downward upon disengagement of the latching arrangement 28, the hinge arrangement 18 can be designed as a friction or detent type of mechanism such that the front cover can be moved only by application of force to the front cover. For instance, the pin 42 can be mounted to the front cover 16 in such a way as to prevent relative rotation between the pin and front cover, and the pin can frictionally engage the side walls 34 so that rotation of the pin requires a torque greater than that exerted by the weight of the front cover alone; alternatively, the pin can be mounted in the side walls to prevent rotation therebetween, and the above-described frictional engagement can be between the pin and the front cover.

The front panel 24 of the front cover can include a vertically extending slot 46 extending downwardly from a rear upper edge of the front panel. The slot 46 can be helpful in removing a bag from the dispenser in that the slot allows the upper end of the bag, grasped just below the hook 20, to be pulled downwardly away from the hook. Such downward force on the bag is generally helpful either for detaching the bag from a tab or header portion that remains engaged on the hook (see, for example, U.S. Pat. No. 5,941,393, particularly FIGS. 5-7 and associated description), or for causing the hook to tear through the aperture in the bag (see, for example, FIGS. 9-15 and associated description in the '393 patent), depending on the particular style of bag being used.

In use, the dispensing apparatus 10 can be mounted on a support stand 50 or other support device, as shown in the first embodiment of FIGS. 1 and 2. The apparatus can also include a cup 52 or the like for holding a quantity of twist ties or other bag closure devices. To prepare the dispensing apparatus for operation, the front cover 16 is opened and a packet P of bags is hung from the hook 20 (FIG. 1). The packet can extend down below the location of the hinge arrangement 18; for instance, the hinge can be located about midway along the vertical extent of the packet. The front cover 16 is then closed (FIG. 2). Any portion of the packet that hangs down below the hinge is folded into the interior of the housing when the front cover is closed.

To remove a bag from the dispenser, the outermost bag in the packet is grasped at a point just below the hook 20 and is pulled forwardly and downwardly, along the slot 46 (if present) in the front cover, so as to sever the severable support means of the bag and detach the bag from the hook and the remaining bags. If the bag is a self-opening bag such as described in the aforementioned U.S. Pat. Nos. 6,446,811 and 5,941,393, the process of detaching the bag may also cause the upper end of the bag to be opened up. The bag can then be filled with merchandise. As noted, the dispenser 10 can optionally include a cup 52 or the like for holding a quantity of twist ties or other closures that can be applied to a bag to close it after it has been filled with merchandise.

Figure 7:
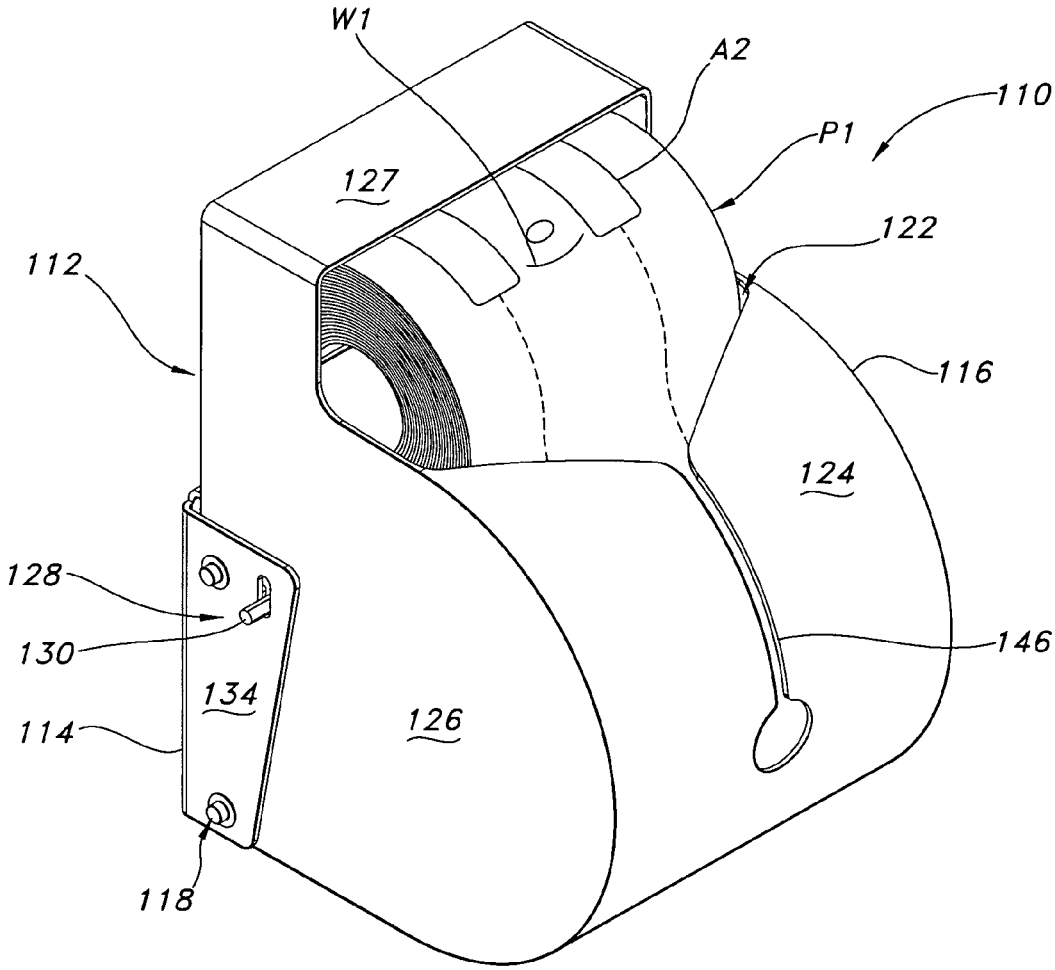
FIG. 7 is a perspective view of a dispenser in accordance with a third embodiment of the invention, shown in a closed condition with a packet of bags loaded in the dispenser.
Figure 8:
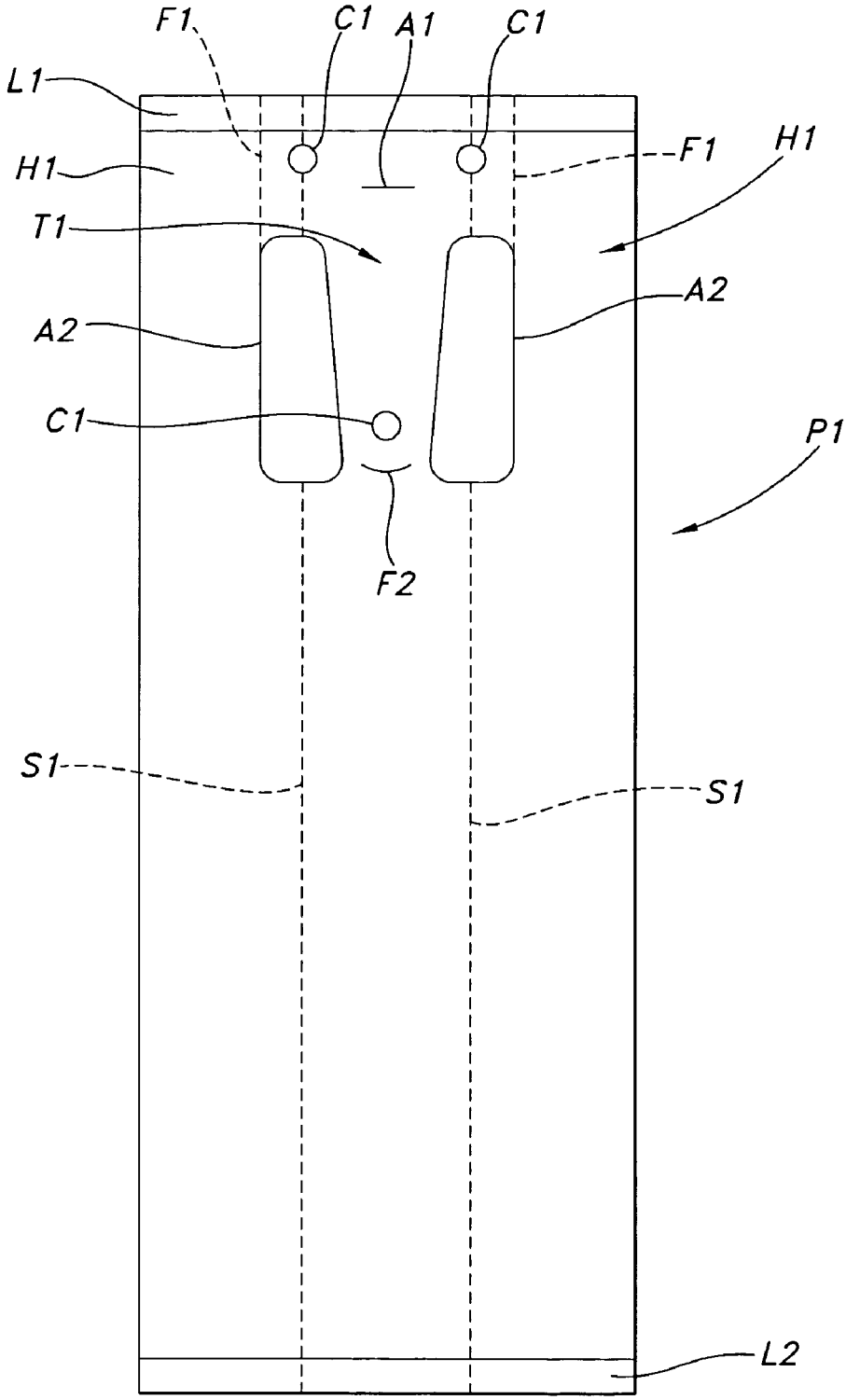
FIG. 8 depicts a packet of T-shirt style bags as used with the dispenser of FIG. 7 according to one embodiment of the invention.

The invention is susceptible to numerous variations. For instance, FIG. 7 shows a dispensing apparatus 110 in accordance with a further embodiment of the invention. The dispensing apparatus 110 differs from the apparatus 10 described above primarily in the arrangement by which a bag packet P1 is secured in the dispenser 110. The packet P1, shown individually in FIG. 8, is illustrated as a packet of T-shirt style bags. Each bag of the packet P1 is sealed at the top and bottom by heat seals L1, L2, and the packet P1 defines two apertures A2 extending therethrough and severable means that facilitate the removal of bags from the packet. In particular, perforations F1 extend between the apertures A2 and a top of the packet, and another perforation F2 connects the apertures A2. Each bag is configured to be torn along the perforations F1, F2 when removed from the remaining packet so that a tab T1 of each bag remains with the packet. A slot-like aperture A1 in the tab is structured to receive a hook or other bag mount. As shown in FIG. 8, the sides of each bag are folded to form side gussets, and the side edges S1 of each bag are intersected by the apertures A2. Thus, when a bag is removed from the packet, the mouth portion of the bag is open with two loop-like handles H1 extending (upward as shown in FIG. 8) from the mouth portion. Weld areas C1 can be formed as heat welded points that extend through the packet so that all of the tabs of the bags are adhered to one another and the tabs are not removed from the packet as the bags are torn therefrom.

Figure 9:
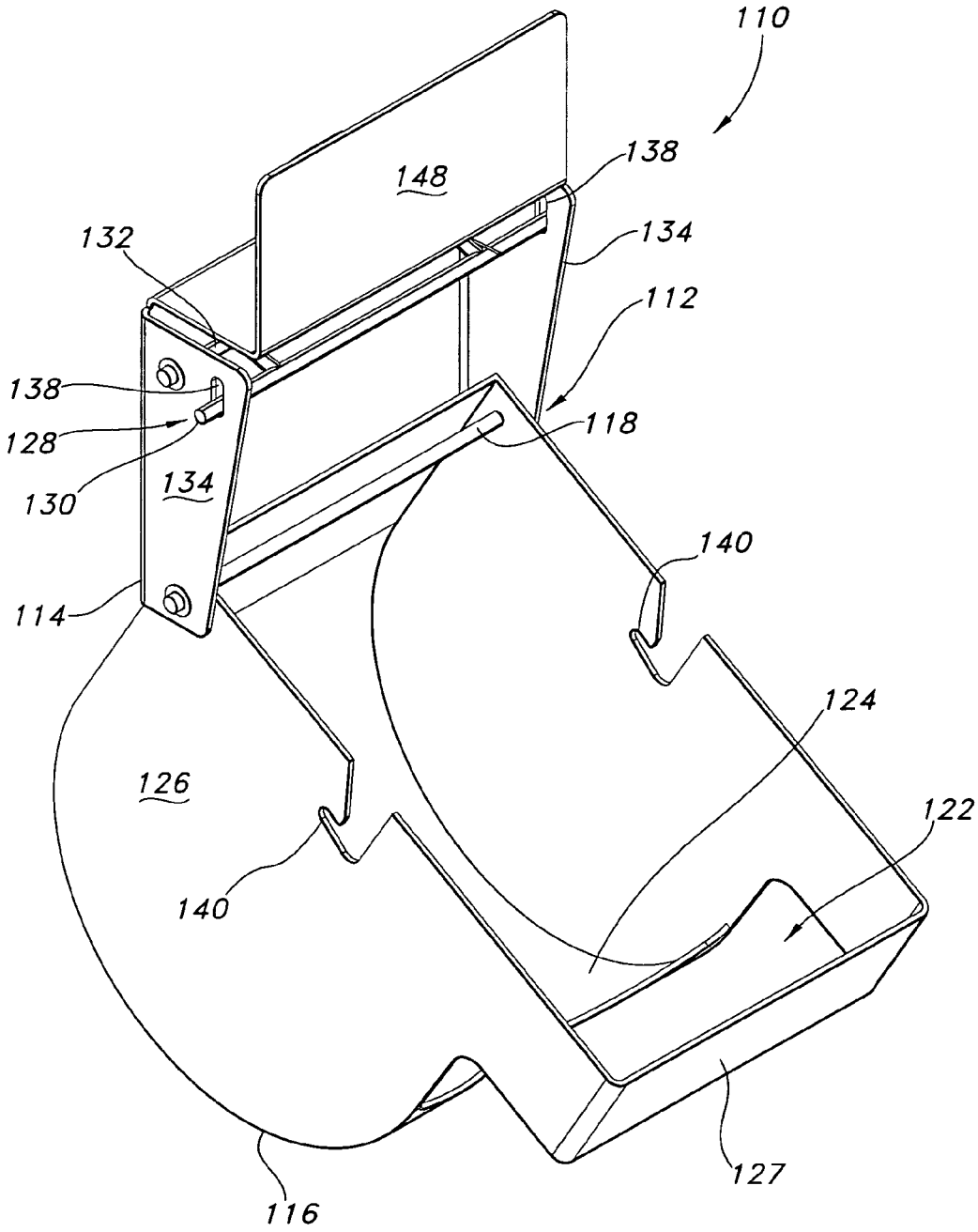
FIG. 9 is a perspective view of the dispenser of FIG. 7, shown with the dispenser open and without the packet of bags.
Figure 10:
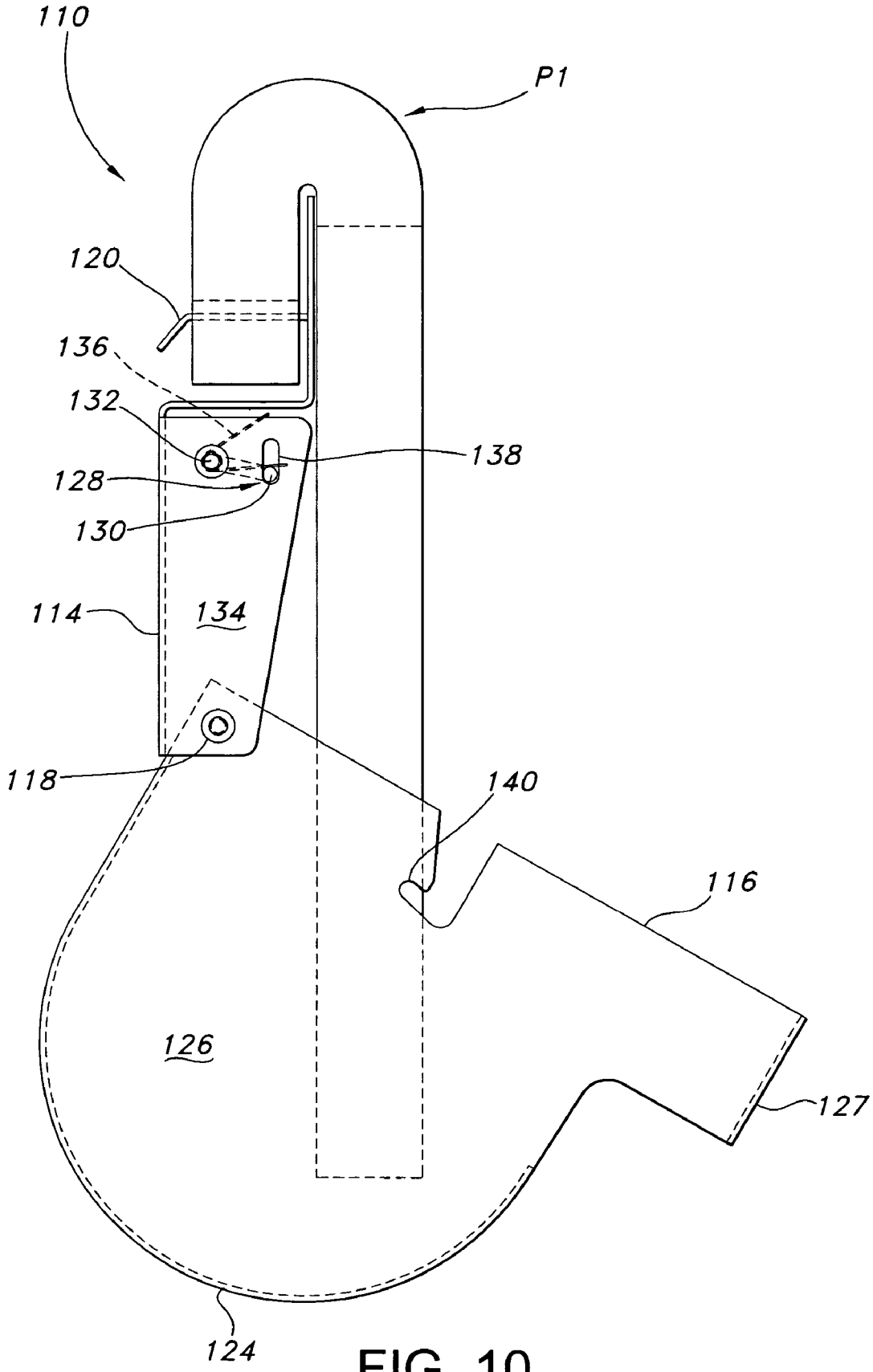
FIG. 10 is a side elevation of the dispenser of FIG. 7.

The dispensing apparatus 110 of FIGS. 7, 9, and 10 includes a housing 112 formed by a rear portion 114 and a front cover 116. The rear portion and front cover are pivotally connected to each other by a hinge arrangement 118 located proximate a bottom edge of the rear portion. The hinge arrangement is attached to the front cover at a location proximate a lower end (when the front cover is closed as shown in FIG. 7) of the front cover. By virtue of the hinge arrangement, the front cover can be pivoted between a closed position (FIG. 7) and an open position (FIG. 9).

As shown in FIG. 10, a bag mount or hook 120 for engaging the aperture A1 in the bag packet P1 extends rearwardly from a flange 148 of the rear portion 114 of the dispensing apparatus 110. Thus, with the flange 148 positioned in a vertical arrangement, the packet can be disposed so that the hook 120 extends through the aperture A1, and the packet can be folded over the flange so that the packet hangs from the flange and the hook with the lower portion of the packet contained in the interior space of the housing 112.

Similar to the embodiment described above in connection with FIG. 1, the dispensing apparatus 110 defines an opening 122 in the housing 112. The mouth portion of the bag packet P1 is thus presented for ready access through the opening 122, while the lower ends of the bags can be contained within the housing and hence are not readily accessible as long as the front cover 116 is closed as shown in FIG. 7. It is appreciated that while the opening 122 in the illustrated embodiment is on an upper side of the housing, the opening can alternatively be on another side of the housing, such as the front side.

The front cover 116 in the illustrated embodiment defines a front panel 124 of curved, generally U-shaped form, and a pair of spaced, parallel side panels 126 joined to the opposite side edges of the front panel 124. A cover member 127 extends between the side panels so that the opening 122 is defined between the cover member 127 and the front panel 124. A latching arrangement 128 for latching the front cover in the closed position includes a latch member 130 that is connected to a pivot member 132, each of which can be in the form of a wire or rod configured so that the latch member 130 is substantially parallel to the pivot member 132 and is spaced from the pivot member in a forward direction (i.e., toward the front cover 116). The pivot member 132 is journaled for rotation about its axis in apertures formed through a pair of laterally spaced, parallel walls 134 that are joined to opposite side edges of the rear portion 114. A torsion spring 136 is affixed to the pivot member 132 and engages the latch member 130 to bias the latch member in a downward direction. The opposite ends of the latch member 130 extend outwardly through vertically elongated apertures 138 in the walls 134, and the torsion spring 136 biases the latch member downwardly against the lower edges of the apertures 138. Thus, the latch member is structured to engage latching slots 140 in the side panels 126 when the front cover 116 is closed to prevent the front cover from being opened. The front cover can be opened by pushing the opposite ends of the latch member 130 upwardly against the force of the torsion spring 136 to disengage the latch member from the latching slots 140, and pulling the front cover forwardly.

The front panel 124 of the front cover can also include a vertically extending slot 146 extending partially through the front panel from the opening 122 to aid in the removal of a bag from the dispenser 110. The slot allows the upper end of the bag, grasped proximate to the mouth of the bag and below the tab T1, to be pulled downwardly away from the flange 148 and hook 120. As described above, such downward force on the bag is generally helpful for detaching the bag from the tab T1 that remains engaged to the packet and the dispensing apparatus 110. In other embodiments of the present invention, a dispensing apparatus similar to the one shown in FIG. 7 can be used to dispense bags that do not define a tab, and the opening 122 can be helpful for causing the hook to tear through an aperture in the bag to release the bag from the hook. In any case, the dispensing apparatus 110 can be mounted on a support stand or other support device, as set forth above, and can include a cup or other device for holding twist ties and the like.

To prepare the dispensing apparatus 110 for operation, the front cover 116 is opened and a packet P1 of bags is hung from the hook 120 (FIG. 10). The packet can extend down below the location of the hinge arrangement 118; for instance, the hinge can be located about midway along the vertical extent of the packet. The front cover 116 is then closed (FIG. 7). A portion of the packet that hangs down below the hinge can be folded into the interior of the housing when the front cover is closed.

To remove a bag from the dispenser 110, the outermost bag in the packet is grasped at a point just below the tab and is pulled forwardly and downwardly, along the slot 146 (if present) in the front cover, so as to sever the severable support means of the bag and detach the bag from the hook and the remaining bags. The process of detaching the bag can cause the mouth portion of the bag to be opened, and the bag can then be filled with merchandise.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A dispensing apparatus for a packet of plastic bags, the packet having a mouth portion at which open ends of the bags are located, the mouth portion defining severable support means for the packet, the dispensing apparatus comprising:

a bag mount structured and arranged to engage the severable support means of the packet of bags so as to secure the packet to the bag mount; and a housing connected to the bag mount, the housing defining an opening in a side of the housing proximate the bag mount such that the packet secured by the bag mount has the mouth portion of the packet aligned with the opening in the housing and a lower portion of the packet is contained in the housing, whereby the mouth portion of the packet is accessible through the opening in the housing to allow bags to be removed one at a time from the packet while the housing substantially prevents access to the lower portion of the packet, wherein the housing comprises a rear portion and a front cover connected to the rear portion, the front cover being pivotally attached to the rear portion so as to be movable between an open position providing access to an interior of the housing so that a lower portion of a packet of bags hanging from the bag mount can be received in the interior of the housing, and a closed position in which the housing substantially encloses the lower portion of the packet of bags.

2. The dispensing apparatus of claim 1, wherein the rear portion has a top edge, opposite side edges, and a bottom edge, the bag mount being affixed to the rear portion proximate the top edge of the rear portion, the front cover being movable between a lowered, open position providing access to an interior of the housing and a raised, closed position in which the housing substantially encloses the lower portion of the packet of bags.

3. The dispensing apparatus of claim 2, wherein the front cover comprises a front panel having opposite side edges, and two spaced side panels respectively joined to the opposite side edges of the front panel.

4. The dispensing apparatus of claim 3, wherein the front panel defines a slot through which bags can be withdrawn as the bags are removed one at a time.

5. The dispensing apparatus of claim 3, wherein the front panel has a curved, generally U-shaped configuration.

6. The dispensing apparatus of claim 2, wherein the housing further comprises a hinge arrangement pivotally connecting the front cover to the rear portion of the housing.

7. The dispensing apparatus of claim 6, wherein the hinge arrangement is structured and arranged to prevent the front cover from pivoting relative to the rear portion solely under the weight of the front cover.

8. The dispensing apparatus of claim 1, wherein the bag mount comprises a hook for engaging an aperture in the packet of bags.

9. The dispensing apparatus of claim 1, further comprising a support device affixed to the housing and extending downwardly therefrom to facilitate mounting the dispensing apparatus.

10. The dispensing apparatus of claim 2, further comprising a latching arrangement operable to latch the front cover in the closed position.

11. The dispensing apparatus of claim 10, wherein the latching arrangement comprises a latch member connected to the rear portion and movable between latching and unlatching positions, the front cover defining latching slots positioned to be engaged by the latch member when the front cover is in the closed position and the latch member is in the latching position such that the latch member retains the front cover in the closed position, the latch member moving free of the latching slots when the latch member is in the unlatching position.

12. The dispensing apparatus of claim 2, wherein the bag mount is directed generally away from the front cover such that the packet of bags can be engaged to the bag mount and folded over the top edge of the rear portion, the mouth portion of the packet being directed toward the opening in the housing when the front cover is closed.

13. The dispensing apparatus of claim 12, wherein the front cover defines a cover member structured to be disposed over the top edge of the rear portion when the front portion is closed such that a folded portion of the packet is disposed between the top edge of the rear portion and the cover member.

14. A dispensing system for dispensing plastic bags, comprising:

a packet of plastic bags, the packet having a mouth portion at which open ends of the bags are located, the mouth portion defining severable support means;

a bag mount engaging the severable support means of the packet of bags so as to secure the packet to the bag mount; and a housing defining an opening in a side of the housing proximate the bag mount, the mouth portion of the packet being accessible through the opening in the housing and a lower portion of the packet being contained in the housing, whereby the mouth portion of the packet is accessible to allow bags to be removed one at a time from the packet while the housing substantially prevents access to the lower portion of the packet, wherein each bag of the packet defines a tab portion, the tab portions being bonded in the packet and defined at least partially by perforations such that the tab portions are structured to remain on the bag mount as the bags are removed therefrom.

15. The dispensing system of claim 14, wherein the housing comprises:

a rear portion and a front cover connected to the rear portion, the rear portion having a top edge, opposite side edges, and a bottom edge; and a hinge arrangement pivotally attaching the front cover to the rear portion such that the front cover is movable between a lowered, open position providing access to an interior of the housing so that the lower portion of the packet of bags hanging from the bag mount is received in the interior of the housing, and a raised, closed position in which the housing substantially encloses the lower portion of the packet of bags.

16. The dispensing system of claim 15, wherein the hinge arrangement defines a pivot axis spaced below the bag mount by a distance substantially less than a vertical length of the packet of bags.

17. The dispensing system of claim 15, wherein the hinge arrangement is structured and arranged to prevent the front cover from pivoting relative to the rear portion solely under the weight of the front cover.

18. The dispensing system of claim 15, wherein the front cover comprises a front panel having opposite side edges, and two spaced side panels respectively joined to the opposite side edges of the front panel.

19. The dispensing system of claim 18, wherein the front panel defines a slot through which bags can be withdrawn as the bags are removed one at a time.

20. The dispensing system of claim 18, wherein the front panel has a curved, generally U-shaped configuration.

21. The dispensing system of claim 15, further comprising a latching arrangement operable to latch the front cover in the closed position.

22. The dispensing system of claim 21, wherein the latching arrangement comprises a latch member connected to the rear portion and movable between latching and unlatching positions, the front cover defining latching slots positioned to be engaged by the latch member when the front cover is in the closed position and the latch member is in the latching position such that the latch member retains the front cover in the closed position, the latch member moving free of the latching slots when the latch member is in the unlatching position.

23. The dispensing system of claim 15, wherein the bag mount is directed generally away from the front cover such that the packet of bags can be engaged to the bag mount and folded over the top edge of the rear portion, the mouth portion of the packet being directed toward the opening in the housing when the front cover is closed.

24. The dispensing system of claim 23, wherein the front cover defines a cover member structured to be disposed over the top edge of the rear portion when the front portion is closed such that a folded portion of the packet is disposed between the top edge of the rear portion and the cover member.

25. The dispensing system of claim 14, wherein adjacent bags of the packet are at least partially bonded such that the mouth portion of each bag is configured to be at least partially opened when pulled from the packet.

26. The dispensing apparatus of claim 2, wherein the housing defines the opening between the rear portion and the front cover, and the bag mount is disposed outside the housing when the front cover is in the closed position.

27. The dispensing apparatus of claim 2, wherein the front cover defines the opening having a width that is at least about as wide as the packet of bags, a second opening, and a slot extending between the openings, the second opening being wider than the slot.

28. The dispensing apparatus of claim 2, wherein the bag mount is directed generally away from the opening in the front cover such that the packet of bags can be engaged to the bag mount and folded over the top edge of the rear portion, the mouth portion of the packet being directed toward the opening in the housing when the front cover is closed, and the front cover defining a cover member structured to be disposed over the bag mount when the front portion is closed.

29. A dispensing apparatus for a packet of plastic bags, the packet having a mouth portion at which open ends of the bags are located, the mouth portion defining severable support means for the packet, the dispensing apparatus comprising:

a bag mount structured and arranged to engage the severable support means of the packet of bags so as to secure the packet to the bag mount;

a housing connected to the bag mount, the housing defining an opening in a side of the housing proximate the bag mount such that the packet secured by the bag mount has the mouth portion of the packet aligned with the opening in the housing and a lower portion of the packet is contained in the housing, whereby the mouth portion of the packet is accessible through the opening in the housing to allow bags to be removed one at a time from the packet while the housing substantially prevents access to the lower portion of the packet; and a support device affixed to the housing and extending downwardly therefrom to facilitate mounting the dispensing apparatus.

30. A dispensing apparatus for a packet of plastic bags, the packet having a mouth portion at which open ends of the bags are located and a lower portion at an end of the packet opposite the mouth portion, the mouth portion defining severable support means for the packet, the dispensing apparatus comprising:

a bag mount structured and arranged to engage the severable support means of the packet of bags so as to secure the packet to the bag mount; and a housing connected to the bag mount, the housing defining an opening in a side of the housing proximate the bag mount such that the packet secured by the bag mount has the mouth portion of the packet and the open ends of each bag aligned with the opening in the housing, and the lower portion of the packet and a closed end of each bag is contained in the housing, whereby the mouth portion of the packet is accessible through the opening in the housing to allow bags to be removed one at a time from the packet while the housing substantially prevents access to the lower portion of the packet.

* * * * *

UNITED STATES PATENT AND TRADEMARK OFFICE

CERTIFICATE OF CORRECTION

PATENT NO. : 7,624,881 B2
APPLICATION NO. : 10/760925
DATED : December 1, 2009
INVENTOR(S) : Harry B. Wilfong, Jr.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 563 days.

Signed and Sealed this

Twenty-first Day of December, 2010

David J. Kappos

David J. Kappos
*Director of the United States Patent and Trademark Office*